US008449406B1

(12) United States Patent
Frame et al.

(10) Patent No.: US 8,449,406 B1
(45) Date of Patent: May 28, 2013

(54) GOLF CLUB HEAD

(75) Inventors: Nicholas Frame, Vista, CA (US); Chris Schartiger, San Diego, CA (US); Michael Walker, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 626 days.

(21) Appl. No.: 12/592,857

(22) Filed: Dec. 2, 2009

Related U.S. Application Data

(60) Provisional application No. 61/201,585, filed on Dec. 11, 2008.

(51) Int. Cl.
*A63B 53/04* (2006.01)

(52) U.S. Cl.
USPC ..... 473/329; 473/332; 473/342; 473/350

(58) Field of Classification Search
USPC ..... 473/324–350
See application file for complete search history.

(56) References Cited

U.S. PATENT DOCUMENTS

| | | | | | |
|---|---|---|---|---|---|
| 819,900 | A | * | 5/1906 | Martin | 473/329 |
| 1,854,548 | A | * | 4/1932 | Hunt | 473/329 |
| 3,061,310 | A | * | 10/1962 | Giza | 473/329 |
| 3,989,248 | A | * | 11/1976 | Campau | 473/329 |
| 4,664,383 | A | * | 5/1987 | Aizawa | 473/329 |
| 5,090,702 | A | * | 2/1992 | Viste | 473/331 |
| 5,221,087 | A | * | 6/1993 | Fenton et al. | 473/342 |
| 5,328,175 | A | * | 7/1994 | Yamada | 473/346 |
| 5,403,007 | A | * | 4/1995 | Chen | 473/342 |
| 5,405,137 | A | * | 4/1995 | Vincent et al. | 473/342 |
| 5,692,972 | A | * | 12/1997 | Langslet | 473/332 |
| 5,766,092 | A | * | 6/1998 | Mimeur et al. | 473/329 |
| 5,766,093 | A | * | 6/1998 | Rohrer | 473/329 |
| 5,766,094 | A | * | 6/1998 | Mahaffey et al. | 473/342 |
| 5,924,939 | A | | 7/1999 | Grace et al. | |
| 5,944,619 | A | * | 8/1999 | Cameron | 473/332 |
| 6,001,030 | A | * | 12/1999 | Delaney | 473/329 |
| 6,042,486 | A | * | 3/2000 | Gallagher | 473/329 |
| 6,045,456 | A | * | 4/2000 | Best et al. | 473/291 |
| 6,093,116 | A | * | 7/2000 | Hettinger et al. | 473/332 |
| 6,159,109 | A | * | 12/2000 | Langslet | 473/332 |
| 6,193,615 | B1 | * | 2/2001 | Hirota | 473/329 |
| 6,368,231 | B1 | | 4/2002 | Chen | |
| 6,443,857 | B1 | * | 9/2002 | Chuang | 473/332 |
| 6,981,923 | B2 | | 1/2006 | Chappell | |
| 6,986,715 | B2 | * | 1/2006 | Mahaffey | 473/305 |
| 7,070,513 | B2 | * | 7/2006 | Takeda et al. | 473/329 |
| 7,261,644 | B2 | * | 8/2007 | Burrows | 473/340 |
| 7,281,990 | B2 | * | 10/2007 | Hagood et al. | 473/329 |
| 7,367,898 | B2 | * | 5/2008 | Hawkins et al. | 473/329 |
| 7,473,186 | B2 | * | 1/2009 | Best et al. | 473/329 |
| 7,500,923 | B2 | * | 3/2009 | Tateno | 473/329 |

(Continued)

FOREIGN PATENT DOCUMENTS

| | | | | |
|---|---|---|---|---|
| JP | 10155950 | A | * | 6/1998 |
| JP | 10192456 | A | * | 7/1998 |

*Primary Examiner* — Alvin Hunter
(74) *Attorney, Agent, or Firm* — Klarquist Sparkman, LLP

(57) ABSTRACT

A golf club head is provided having a club body and a contact plate secured to the club body. The contact plate defines at least a portion of a striking surface having a plurality of striking surface grooves. A plurality of soft portions is provided that are coupled to a rear surface of the contact plate. The plurality of soft portions also corresponds to the plurality of striking surface grooves.

18 Claims, 11 Drawing Sheets

U.S. PATENT DOCUMENTS

| | | | | |
|---|---|---|---|---|
| 7,621,822 | B2 * | 11/2009 | Roach | 473/329 |
| 7,708,653 | B2 * | 5/2010 | Hawkins et al. | 473/329 |
| 7,713,139 | B1 * | 5/2010 | Stites et al. | 473/329 |
| 7,794,333 | B2 * | 9/2010 | Wallans et al. | 473/331 |
| 7,806,779 | B2 * | 10/2010 | Franklin et al. | 473/251 |
| 7,927,230 | B2 * | 4/2011 | Solheim | 473/329 |
| 7,942,757 | B2 * | 5/2011 | Blumenkrantz et al. | 473/331 |
| 7,985,146 | B2 * | 7/2011 | Lin et al. | 473/330 |
| 8,070,624 | B2 * | 12/2011 | Oldknow et al. | 473/329 |
| 8,092,318 | B2 * | 1/2012 | Oldknow et al. | 473/329 |
| 8,105,181 | B2 * | 1/2012 | Blumenkrantz et al. | 473/331 |
| 8,157,670 | B2 * | 4/2012 | Oldknow et al. | 473/324 |
| 2007/0026965 | A1 * | 2/2007 | Huang | 473/342 |

* cited by examiner

GOLF CLUB HEAD

CROSS REFERENCE TO RELATED APPLICATION

This application is a non-provisional application claiming priority to and benefit of U.S. Provisional Patent Application No. 61/201,585, filed Dec. 11, 2008, which is incorporated herein by reference.

FIELD

The disclosure pertains to golf clubs and methods of manufacturing golf clubs.

BACKGROUND

Technologies have been developed for both golf balls and golf clubs to provide a certain sound or feel. However, some "off-center" hits produce an undesirable vibration that a golfer can feel through his hands. In addition, an undesirable sound can be produced from the same type of off-center hits. For example, a golfer may have a shallow swing that misses the sweet spot of the striking surface and thereby creates contact with a leading edge of the striking surface. Because the speed of the club head generates a large amount of force upon impact with the golf ball, a significant vibration can be transferred through the club shaft and grip to the golfer's hands. As golf manufacturers and designers seek to improve various areas of club performance, the "feel" characteristics of a golf club must achieve a certain level of performance.

SUMMARY OF THE DESCRIPTION

Golf club heads comprise a club body and a striking plate secured to the club body. The striking plate comprises a contact plate defining at least a portion of a striking surface having a plurality of striking surface grooves.

According to one aspect of the present invention, a plurality of soft portions is coupled to a rear surface of the contact plate and the plurality of soft portions corresponds to the plurality of striking surface grooves.

In one example of the present invention, the plurality of soft portions is located behind the contact plate and overlap with the plurality of striking surface grooves along an axis parallel to the striking surface.

In one example of the present invention, the plurality of soft portions is substantially offset from the striking surface grooves. In another aspect of the present invention, at least one soft insert in a back portion is provided that includes the plurality of soft portions.

In one example of the present invention, the plurality of soft portions is located in at least one cavity. The at least one cavity is defined by a varying thickness of a back portion. Furthermore, the plurality of soft portions is configured to provide at least one soft portion that corresponds to each striking surface groove of the plurality of striking surface grooves.

In another aspect of the present invention, the back portion defines at least one cavity portion located between the back portion and the contact plate. The at least one cavity portion has a first volume. Moreover, the contact plate has at least one rear surface groove that has a groove volume. The first volume of the at least one cavity portion includes the groove volume of the at least one rear surface groove.

In one example of the present invention, the at least one cavity portion is filled with a gel and the at least one cavity portion is a channel that extends to at least one fill aperture.

According to another aspect of the present invention, a golf club head is provided having a club body and a contact plate secured to the club body. The contact plate has a striking surface with at least one striking surface groove and a rear surface having at least one rear surface groove associated with the at least one striking surface groove.

In one example of the present invention, the at least one rear surface groove is located opposite the at least one striking surface groove on the contact plate. Furthermore, the at least one rear surface groove and the at least one striking surface groove define a contact plate thickness that is substantially thinner than any other portion of the contact plate.

According to another aspect of the present invention, a golf club head having a striking plate and a plurality of grooves defined on a striking surface is provided. In addition, a head body including a forward surface at which the striking plate is secured to the head body is provided so that the forward surface defines at least one support protrusion. The support protrusion in combination with the striking plate defines a channel located between a rear surface of the striking plate and the forward surface of the club head.

In one example of the present invention, the channel is substantially unfilled, but in other embodiments the channel is substantially filled with a gel or other soft material. In another example, the channel is substantially filled with a solid that is less stiff than the head body.

In one aspect of the present invention, the at least one support protrusion is a plurality of support protrusions that include horizontal portions that extend substantially parallel to the respective plurality of grooves. The horizontal portions include a horizontal portion centerline that is vertically offset from a respective groove centerline by a distance of between about 0.05 mm and 1.5 mm.

According to another aspect of the present invention, a golf club head is provided having a club body and a two-piece striking plate insert secured to the club body. The first piece includes a contact plate defining at least a portion of a striking surface having a plurality of striking surface grooves. A second piece is provided that engages with the first piece to create at least one cavity. Furthermore, at least one soft portion is coupled to a rear surface of the first piece and is configured to provide vibration damping. In one example of the present invention, the at least one cavity is filled with a soft material.

These and other features and aspects of the disclosed technology are set forth below with reference to the accompanying drawings.

DETAILED DESCRIPTION

Figure 1A:
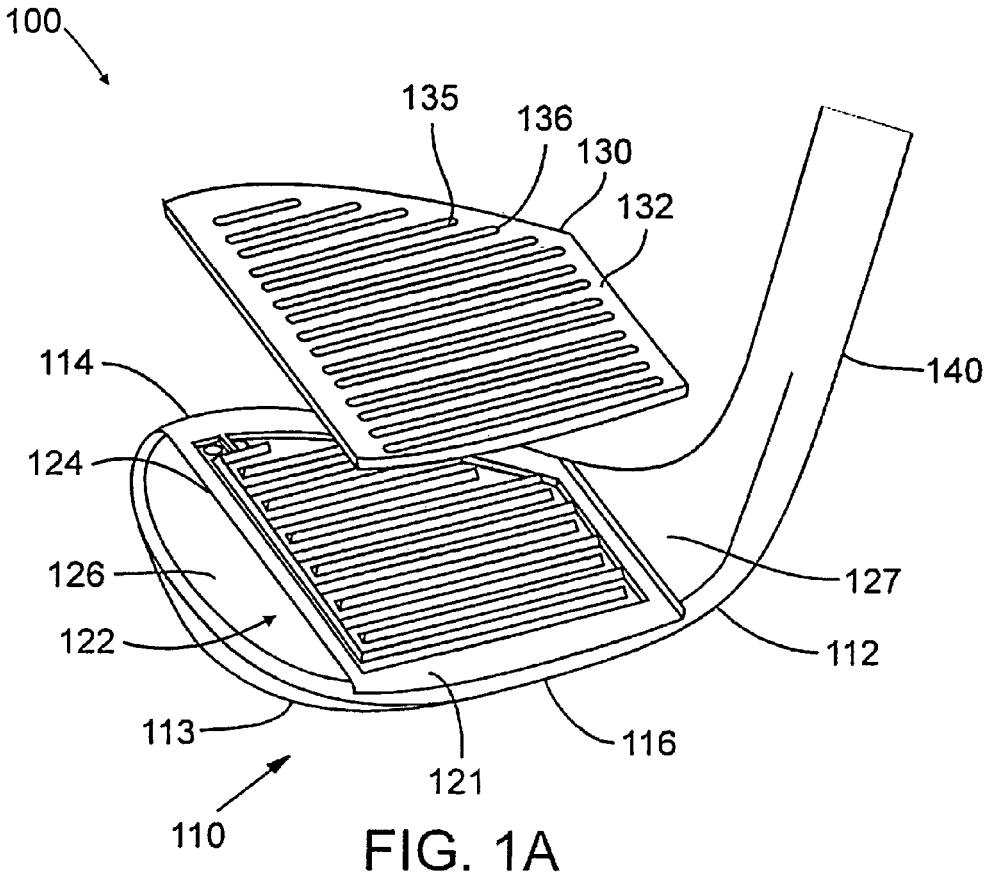
FIG. 1A is an exploded view of a representative iron-type golf club head.

Referring to FIGS. 1A-1D, a representative iron-type club head 100 includes a head body 110 and a striking plate or contact plate 130. The head body 110 includes a heel 112, a toe 113, a top line 114, a sole 116, and a hosel 140 configured to attach the club head 100 to a shaft (not shown in FIGS. 1A-1D). The head body 110 defines a striking plate mounting region 121 configured to receive the striking plate 130. Club head mass may be distributed about the perimeter of the club body 110 based on a particular mass distribution for the club head 100 selected by a club head designer. Perimeter weighting can take various forms. One design includes a sole bar or other mass at or near the club head sole 116 to provide a center of gravity that is situated low in the club head 100 and behind the striking plate 130 as viewed from a striking surface 132 of the club head.

For convenience herein, positions and spacings of club components and features are described with respect to a club as situated in a normal address position. Directions from a club face toward a golf ball are referred to as forward, and directions away from the golf ball are referred to as rearward. Directions noted as up and down are vertically up and down with the club situated in a normal address position.

As shown in FIG. 1A, the striking plate 130 and the head body 110 may be formed separately. In such a design, the completed club head is made by securing the striking plate 130 to the mounting area 121 by welding or other process. A front surface 122 of the club is defined by both a striking surface 132 of the striking plate 130 and portions 126, 127 of the club body 110. The front surface 122 can be polished or ground to remove any front surface edges situated at a striking plate/club body seam 124. In some examples, the portions 126, 127 are polished and the front surface 132 of the striking plate 130 is finely ground. The striking surface 132 is a substantially planar grooved surface configured to strike a golf ball, although for some players, other portions of the front surface 122 also contact the golf ball.

As noted above, grinding and/or polishing operations can be used to remove any excess material or irregularities introduced in the welding process, or to provide a selected club head appearance such as, for example, a specularly reflective polished appearance, a fine ground appearance, or other appearance. The striking plate 130 includes a set of grooves, such as exemplary grooves 135, 136 formed in the striking surface 132.

As described above, the striking plate 130 and the head body 110 may be formed separately. However, alternative manufacturing processes can also be used. For example, the head body 110 and the striking plate 130 can be formed as one piece using various forging, casting, and molding processes as are commonly practiced by golf club head manufacturers. Where the head body 110 and the striking plate 130 are formed as one piece, the substantially planar striking surface 132 is defined by the one piece club head.

Figure 1B:
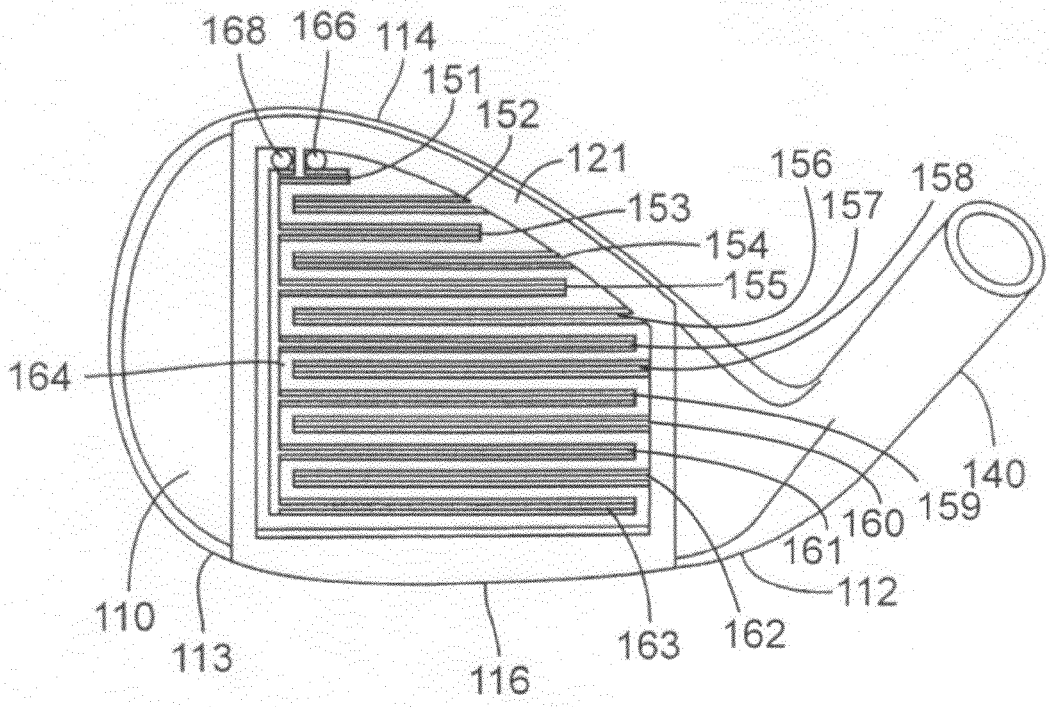
FIG. 1B is an elevational view of a head body of the iron-type golf club head of FIG. 1A.
Figure 1C:
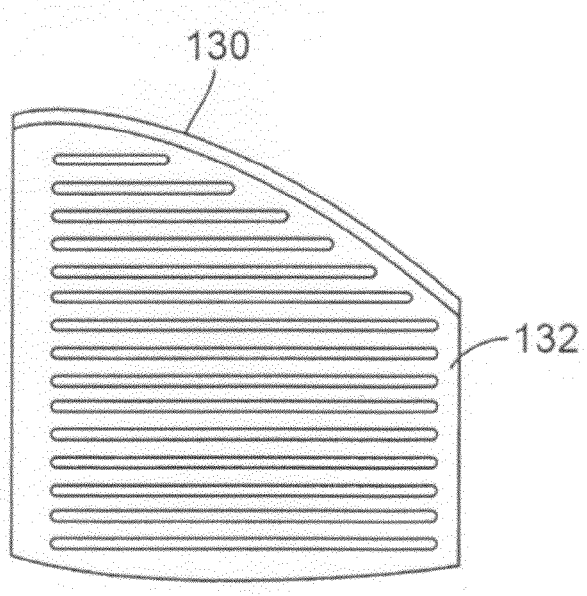
FIG. 1C is an elevational view of a striking plate of the iron-type golf club head of FIG. 1A.
Figure 1D:
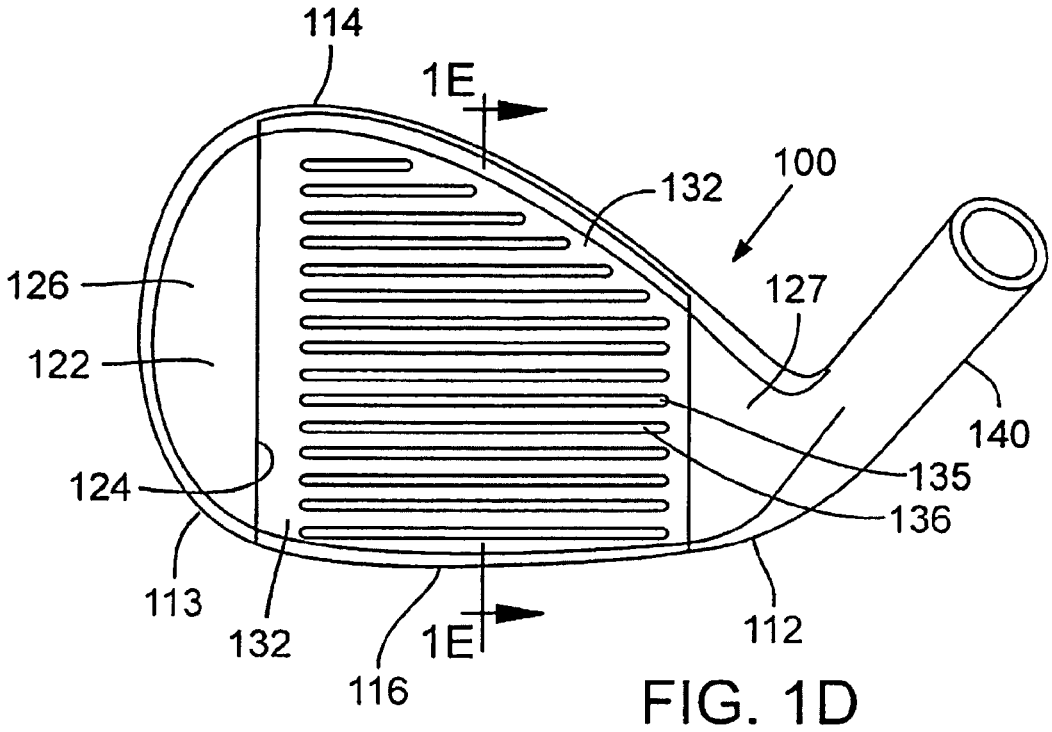
FIG. 1D is an elevational view of the iron-type golf club head of FIG. 1A.
Figure 1E:
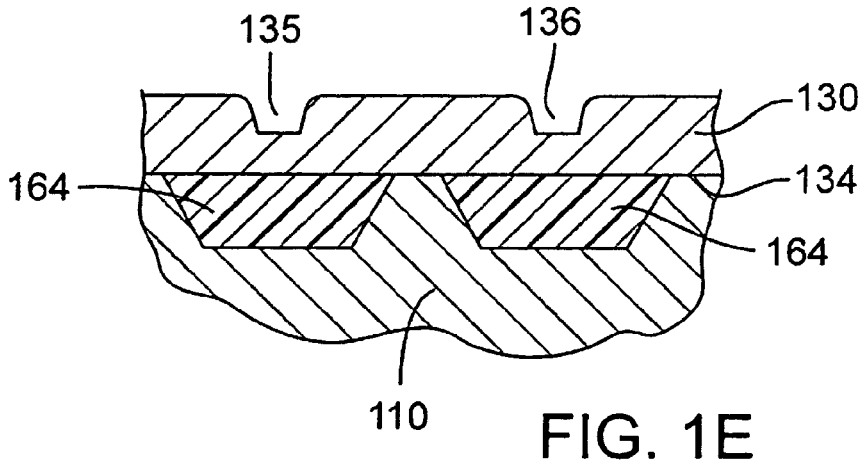
FIG. 1E is a partial sectional view of the iron-type golf club head of FIG. 1A.

Referring to FIGS. 1B and 1E, the club body 110 includes one or more ridges such as ridges 151-163 situated behind the striking plate 130. The ridges 151-163 define a channel 164 that is in communication with ports 166, 168 that are located on a back side of the club body 110. The channel 164 can be filled with a soft or other solid material, or can be filled with a gas, liquid, gel, or can be evacuated to remain unfilled. The ports 166, 168 permit convenient filling of the channel 164 after attachment of the striking plate 130 to the club body 110. In other examples, a soft gasket can be inserted into the channel 164 prior to attachment of the striking plate 130, or the channel 164 can be filled prior to attachment of the striking plate 130. The fill material can be a fluid such as an epoxy that can be cured after attachment and can include a loading material such as spheres, rods, fibers or other particles that are distributed throughout the fill material. In some examples, variable softness can be provided by spatially variable loading of the fill material. In other examples, multilayer fill materials are used so that, for example, a first layer is situated in contact with a rear surface 134 of the contact plate 130 and a second material contacts the club body 110. Other laminar structures comprising alternating layers of materials having varying modulus of elasticity values can also be used. Depending on material selection, the ports 166, 168 can be sealed or remain open, or can be omitted entirely.

As shown in FIGS. 1B and 1E, at least some of the ridges 151-163 are configured to contact the rear surface 134 of the striking plate 130, and the material 164 in the channel also contacts the rear surface 134. In one example, the channel fill material 164 is softer than the ridges 151-163, and the filled channel portions are situated directly in back of and approximately centered with the striking plate grooves. It is understood that the ridges 151-163 do not need to directly contact the rear surface 134. In other examples, the filled channel portions can be offset with respect to the striking plate grooves, or other combinations of material softness and groove offsets can be used. As shown in FIG. 1E, each groove has a corresponding channel fill portion, but in other examples every second, third, fourth, or other selected grooves are provided with corresponding channels and some channels or channel portions can remain unfilled.

The thickness of the striking plate 130 can be selected to reduce mass associated with the striking plate 130, so that additional mass can be distributed to other parts of the club head to achieve intended club design goals. The striking plate thickness is selected consistent with long term club use to avoid premature striking plate failure due to fatigue cracking and other such failure modes, and redistributed mass is situated low on the club head and rearward of the striking plate 130 or wherever needed to dictate a desired performance. Some examples of materials that can be used to form the striking plate and the head body include, without limitation, carbon steels (e.g., 1020 or 8620 carbon steel), stainless steels (e.g., 304, 410, or 431 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, nickel alloys, glass fiber reinforced polymers (GFRP), carbon fiber reinforced polymers (CFRP), metal matrix composites (MMC), ceramic matrix composites (CMC), and natural composites (e.g., wood composites). High strength materials having a relatively high modulus of elasticity (greater than about 50 GPa, 100 GPa, 150 GPa, 200 GPa, or 250 GPa) are generally preferred. In use, the striking plate 130 is subject to numerous high speed impacts with a golf ball, and should resist permanent deformation. Different types of irons (e.g., long irons and short irons) can experience different forces in golf ball impacts, and the striking plate thickness can be adjusted accordingly, if desired.

Some examples of materials that can be used to fill a striking plate/back plate cavity or to provide regions of different softness include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one embodiment, the channel fill material may have a modulus of elasticity ranging from about 0.001 GPa to about 25 GPa, and a durometer ranging from about 5 to about 95 on a Shore D scale. In one embodiment, the channel fill material is an epoxy adhesive having a cured Shore D hardness value of about 75-80. In other examples, gels or liquids can be used, and softer materials which are better characterized on a Shore A or other scale can be used. The Shore D hardness on a polymer is measured in accordance with the ASTM (American Society for Testing and Materials) test D2240.

As shown in FIGS. 1B and 1E, the channel 164 is filled with a material that has a greater softness (i.e., better feel) than the club body material and the striking plate material. In other examples, materials can be selected so that the channel fill material is relatively less soft (i.e., harder) than one or both of the club body and the striking plate 130. In other examples, one or more layers or channels are situated behind the striking plate 130. For convenience in describing some representative embodiments, a striking plate that includes rear surface supports (such as channel 164 of FIGS. 1B and 1E) is referred to as a "compound striking plate." In such examples, a surface that is situated to contact a golf ball during normal play is referred to as a striking surface, and the metallic or other material that provides the striking surface is referred to as a contact plate. One or more additional layers can also be provided such as a back plate situated behind the contact plate.

Figure 2:
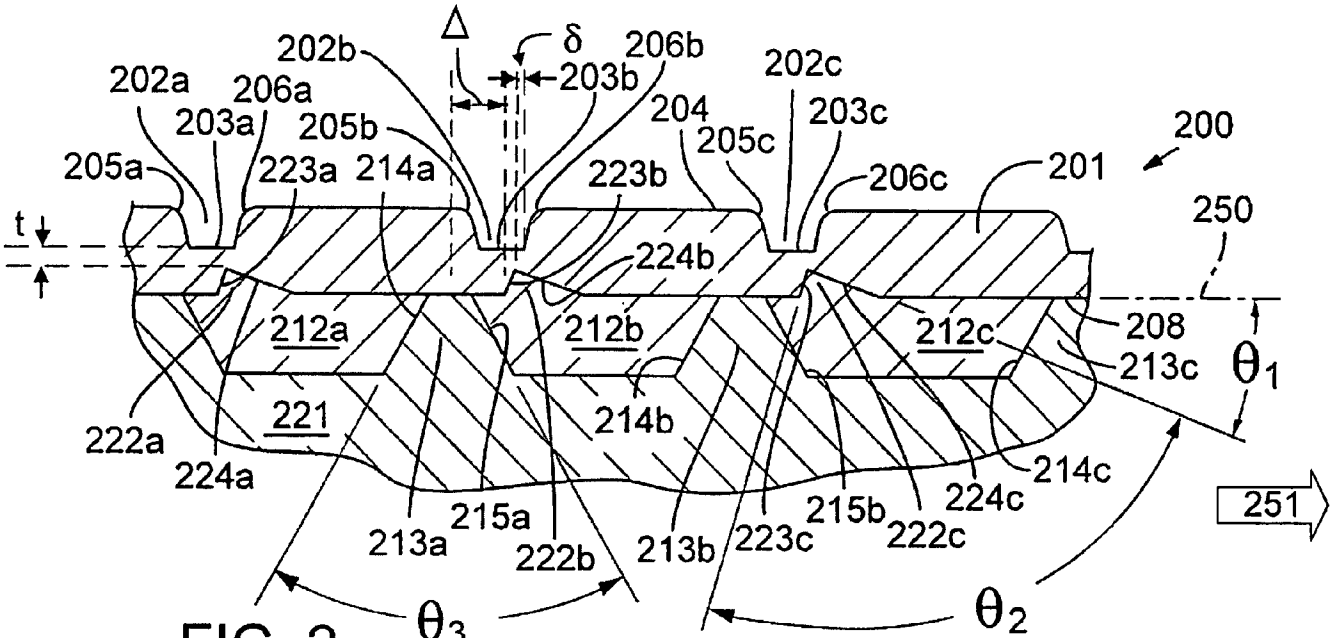
FIG. 2 is a partial sectional view of a striking plate for an iron-type golf club head that includes a plurality of grooves on a striking surface and a corresponding plurality of protrusions in a back plate that are configured to contact the striking plate, according to one embodiment.

A portion of a representative compound striking plate 200 is illustrated in FIG. 2. The striking plate 200 includes a contact plate 201 and a back plate 221 (or back portion) that both define a plurality of intermediate cavities 212*a*-212*c*. The contact plate 201 includes a plurality of grooves 202*a*-202*c* in a striking face 204. Each of the grooves 202*a*-202*c* includes a bottom surface 203*a*, 203*b*, 203*c* and sides 205*a*, 205*b*, 205*c* and 206*a*, 206*b*, 206*c*, respectively. The transitions between the bottom surfaces 203*a*-203*c* and the sides 205*a*-205*c*, 206*a*-206*c* are radiused to provide smooth transitions, and the radii of curvature are less than about 0.508 mm and groove widths are less than about 0.9 mm. The grooves 202*a*-202*c* can be formed by machining, casting, or other processes and, in practical examples, have dimensions, transition radii, and other parameters selected so as to conform to the Rules of Golf. The contact plate 201 is based on a metal plate of a material such as those mentioned above with reference in FIGS. 1A-1E.

In the example of FIG. 2, a rear surface 208 of the contact plate 201 includes a plurality of rear surface grooves 222*a*-222*c* that have points which are offset a distance δ from an intersection of respective groove sides 206*a*-206*c* and groove bottoms 203*a*-203*c*. In the example of FIG. 2, the rear surface grooves 222*a*-222*c* are defined by two sides 223*a*-223*c*, 224*a*-224*c* so as to have cross-sectional areas corresponding to right triangles. An angle $\theta_1$ between the side 224*c* and a vertical axis 250 that is parallel to the striking face 204 is about 20°, and an angle $\theta_2$ between the first side 223*c* and the second side 224*c* is about 90°. In one example, the contact plate thickness at the thickest location or a first thickness is about 1.0-1.2 mm. In one embodiment, the offset distance δ is about 0.1 mm, and the rear surface grooves 222*a*-222*c* are about 0.3 mm deep. In other examples the contact plate thickness is about 3.0 mm.

FIG. 2 further shows a second thickness t of the contact plate 201 located between the rear surface groove 222*a*-222*c* points and front groove bottoms 203*a*-203*c*. In one embodiment, the second thickness t is the thinnest portion of the contact plate 201. In some exemplary embodiments, the contact plate 201 is made of steel and the second thickness t is about 0.23 mm while the overall thickness of the contact plate 201 is about 1.0 mm. It is understood that the overall thickness of the contact plate 201 can be a range of values as previously described. In other exemplary embodiments, the steel contact plate 201 has a second thickness t of at least greater than about 0.15 mm.

In one embodiment, the contact plate 201 is made of titanium and the second thickness t is about 0.23 mm which is thinner than the overall thickness of the contact plate 201. In other exemplary embodiments, the titanium contact plate 201 is at least greater than about 0.23 mm.

FIG. 2 shows the contact plate 201 having a first thickness and a second thickness t and the relief volumes or intermediate cavities 212*a*-212*c* being located proximate to the contact plate 201 in areas having both the first and second t thicknesses. In other words, the intermediate cavities 212*a*-212*c* have a total volume that includes the volume of the rear surface grooves 222*a*-222*c*.

In one embodiment, the intermediate cavities 212*a*-212*c* are located proximate to the second thickness t to allow a vibration energy from the contact plate 201 to easily proceed to the soft material or cavity 212*a*-212*c*. As a result, the vibration of the impact felt by a golfer can be reduced if the vibration energy is partially absorbed by the soft material or cavity 212*a*-212*c*.

A plurality of support protrusions 213*a*-213*c* extend from the back plate 221 toward the rear surface 208 of the contact plate 201. In some examples, the support protrusions 213*a*-213*c* are situated so as to contact the rear surface 208, or the support protrusions 213*a*-213*c* can be in proximity to the rear surface 208 so that the protrusions 213*a*-213*c* are mechanically coupled to the rear surface 208 when a club head incorporating the compound striking plate 200 contacts a golf ball. The back plate 221 need not be metallic, and can be formed of a variety of metals, plastics, composites, or other materials or combinations of materials such as layers of different materials. The back plate 221 can be formed separately or can be an integral portion of the club head body (shown as item 110 in FIG. 1). In one embodiment, the back plate or back portion 221 is also a forward surface of the club head body. In another embodiment, the back plate or back portion 221 is a separate component that can engage with the forward surface of the club head body.

In the example of FIG. 2, the support protrusions 213*a*-213*b* include respective side walls 214*a*-214*b*, 215*a*-215*b* and the support protrusion 213*c* includes a side wall 214*c* (the other side wall is not shown in the partial sectional view of FIG. 2). The side walls 214*a*, 215*a* and 214*b*, 215*b* define an angle $\theta_3$ that can be about 60° in one example. In one embodiment, the angles $\theta_1$. $\theta_3$ are selected to optimally allow the transfer of vibration to the soft material. The sidewalls 214*a*, 215*a* and 214*b*, 215*b* are symmetrically situated with respect to an axis perpendicular to the striking face 204 so that an angle between each of the side walls 214*a*-214*b*, 215*a*-215*b* and an axis perpendicular to the striking face 204 is about 30°. This configuration is only one example, and asymmetric side walls can be provided, and the support protrusions 213*a*-213*c* can have square, rectangular, pyramidal, triangular, oval, semicircular, or other regular or irregular shapes and can all be of the same or different configurations.

The support protrusions 213*a*-213*c* are located so as to extend substantially parallel to and offset from corresponding groove centerlines by a distance Δ that is less than about ⅓, ⅕, or 1/10 of the distance between grooves (the groove pitch). Protrusion height is generally between about ½ and 2 times the contact plate thickness, but other sizes can be used as convenient. In one embodiment, the support protrusions 213*a*-213*c* include horizontal portions that extend substantially parallel to respective grooves 202*a*-202*c* and each horizontal portion centerline is vertically offset from a respective groove 202*a*-202*c* centerline by a distance between about 0.05 mm to 1.5 mm.

The support protrusions 213*a*-213*c* define intermediate volumes 212*a*-212*c* that extend parallel to the support protrusions 213*a*-213*c*. The intermediate volumes 212*a*-212*c* are created by providing thinner and thicker areas of the back plate 221. For example, the deepest bottom portion of the intermediate volumes 212*a*-212*c* would correspond to a relatively thin cross-section of the back plate 221. In contrast, support protrusions 213*a*-213*b* and side walls 214*a*-214*b*, 215*a*-215*b* of the back plate 221 define the boundaries of the intermediate volumes 212*a*-212*c*. The support protrusions 213*a*-213*b* form a relatively thick cross-section of the back plate 221 when compared to the bottom portion (relatively thinner) of the intermediate volumes 212*a*-212*c*. In some examples, the intermediate volumes or soft portions 212*a*-212*c* are filled with a solid, liquid, or gel material that is softer than the support protrusions 212*a*-212*c*. In other examples, the intermediate volumes are gas filled or are evacuated or unfilled. In still other examples, support protrusions can be arranged to be softer than a fill material in the intermediate volumes.

FIG. 2 further shows a plurality of soft portions 212*a*-212*c* located behind the contact plate 201 and overlapping with the grooves 202*a*-202*c* as measured along an axis parallel to the striking surface. In other words, when viewed from a striking face 204 perspective, the soft portions 212*a*-212*c* overlap with regions of the striking surface grooves 202*a*-202*c*.

As shown in FIG. 2, each of the striking plate grooves 202*a*-202*c* is associated with a corresponding offset rear surface groove 222*a*-222*c* and offset surface protrusion 213*a*-213*c*, but in other examples such features are only provided for every second, third, fourth striking surface groove, or other selection of striking surface grooves.

Moreover, FIG. 2 shows a leading edge direction 251 that is defined as the direction in which a leading edge of the striking plate 200 is located. The leading edge of the striking plate 200 is defined as the edge that makes the first initial contact with a ground surface or ball during a golf shot. In other words, the leading edge is the forward-most edge of the club head where the sole and striking surface intersect or meet. It is understood that the leading edge direction 251 can be in an opposite direction to the direction shown in FIG. 2.

Figure 3:
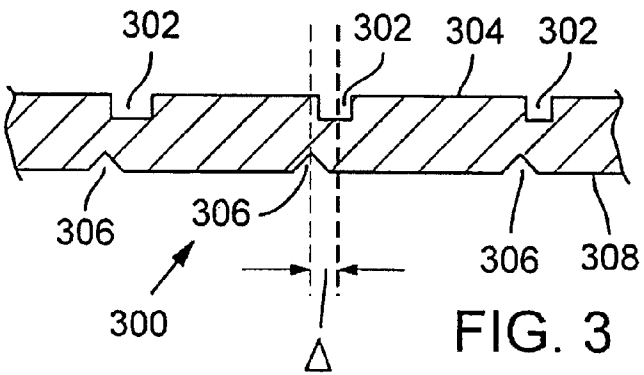
FIG. 3 is a partial sectional view of a striking plate, according to another embodiment.

In other examples, similar features to those of FIG. 2 can be provided in a unitary striking plate. With reference to FIG. 3, a unitary striking plate 300 includes a striking surface 304 that is provided with a plurality of striking surface grooves 302. A rear surface 308 of the striking plate is provided with a plurality of rear surface grooves 306 that are associated with corresponding striking surface grooves 302. As shown in FIG. 3, centers of a rear surface groove and a corresponding striking surface groove are offset a distance Δ. This offset can be selected so that one or more edges of the striking surface grooves 302 are preferentially supported, such as an upper groove edge or a lower groove edge (upper and lower being defined with respect to the striking plate 300 in a normal address position). The rear surface grooves 306 extend substantially the entire length of corresponding striking surface grooves 302, but can extend only partially along the striking surface grooves 302. Because the lengths of the grooves 302 (measured in a horizontal direction with the club head in a normal address position) generally are shorter at a top and bottom of a club head, the rear surface grooves 306 have correspondingly variable lengths. In some examples, the rear surface grooves 306 consist of a plurality of groove segments, and a continuous groove is not necessary. The cross-sections of the rear surface grooves 306 shown in FIG. 3 are merely one example, and rectangular, trapezoidal, semicircular, triangular, or other shapes can be used. Different cross-sectional shapes and dimensions can be used in different portion of the striking plate 300.

Figure 4:
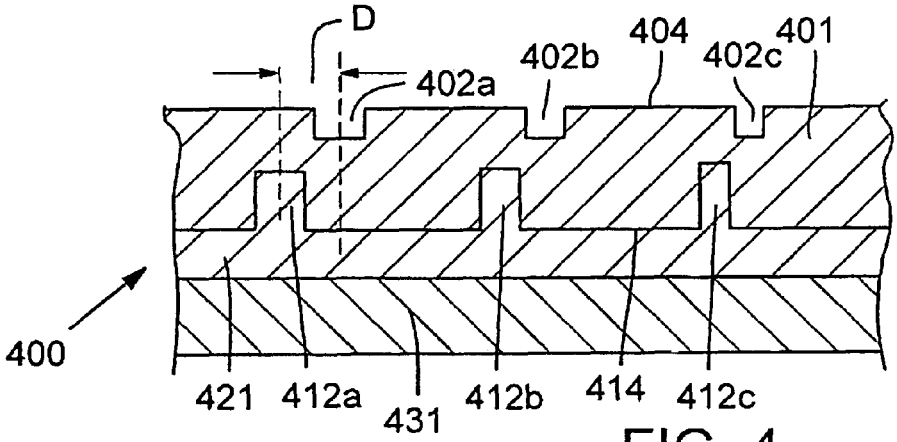
FIG. 4 is a partial sectional view of a striking plate that includes a contact plate, an intermediate layer, and a back plate, according to another embodiment.

Referring to FIG. 4, a compound striking plate 400 includes a contact layer 401, a rear layer 431, and an intermediate layer 421. The contact layer 401 includes a striking surface 404 and a plurality of striking surface grooves 402*a*-

402*c*. A rear surface 414 includes a plurality of grooves 412*a*-412*c*, corresponding to and offset (distance D) from the grooves 402*a*-402*c*. The intermediate layer 421 is an adhesive layer or a layer of a soft material and can be configured to secure the contact layer 401 and the rear layer 431. In some examples, the intermediate layer 421 is configured so as to partially or completely fill the rear grooves 412*a*-412*c*. The rear layer 431 and the contact layer 401 can be formed of metals or other materials, and can be selected to have a total thickness sufficient for durability.

Figure 5:
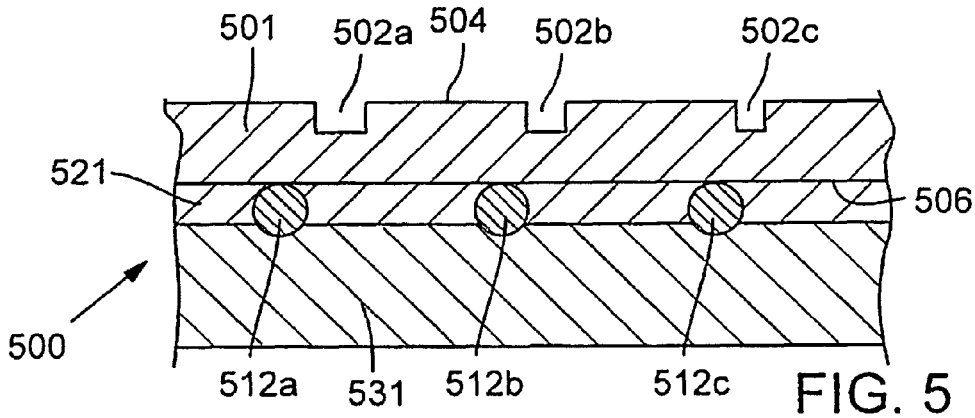
FIG. 5 is a partial sectional view of a striking plate that includes a contact plate, an intermediate layer, a back plate, and a plurality of support members corresponding to striking face grooves, according to another embodiment.

In an example shown in FIG. 5, a compound striking plate 500 includes a contact plate 501, a back plate 531, and an intermediate layer 521. The contact plate 501 provides a striking surface 504 that includes a plurality of grooves 502*a*-502*c*. A plurality of support members 512*a*-512*c* are incorporated at least partially into the intermediate layer 521 and are situated so as to be offset from corresponding grooves 502*a*-502*c*. The support members 512*a*-512*c* can be provided as circular cylindrical metallic bars or as fibers of other materials. Although shown as cylinders that contact a rear surface 506 of the contact plate 501 in FIG. 5, the support members 512*a*-512*c* can have rectangular or other cross sections, and need not contact the rear surface 506. For example, some portions of the intermediate layer 521 can be situated between the support members 512*a*-512*c* and the rear surface 506. In some examples, the support members 512*a*-512*c* are secured or situated in recesses in the back plate 531 or are situated on a back plate surface without corresponding indentations. In further examples, the contact plate 501 can be provided with indentations or recesses configured to receive the support members.

In the example of FIG. 5, the support members 512*a*-512*c* are selected to be less soft than the intermediate layer. For example, the support members 512*a*-512*c* can be formed of a titanium alloy while the intermediate layer is a gel. However, in other examples, the support members are softer than the intermediate layer 521 and are provided as, for example, elastomeric strips situated in grooves formed in the intermediate layer 521.

Figure 6:
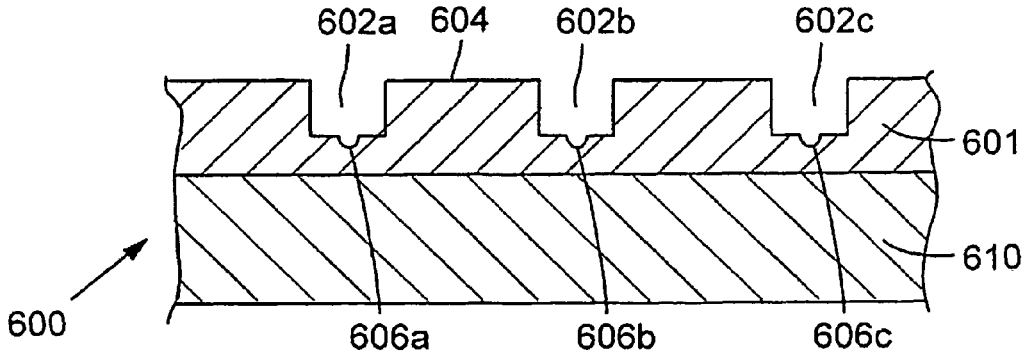
FIG. 6 is a partial sectional view of a striking plate that includes a contact plate and a back plate, according to another embodiment.

In another representative example shown in FIG. 6, a striking plate 600 includes a plurality of grooves 602*a*-602*c* in a striking face 604 of a contact plate 601. Each of the grooves 602 includes a bottom surface notch 606*a*-606*c* at which an effective thickness of the contact plate 601 is reduced. In some examples, a back plate 610 is provided that is formed of relatively stiff but soft material. In one example, the grooves 602*a*-602*c* are between about 0.10 mm and 0.51 mm deep, and a minimum thickness of the contact plate 601 (measured at the bottom surface notch 606) is less than about 0.5, 0.2, or 0.1 mm, and the maximum thickness of the contact plate is between about 0.6 mm and 3.0 mm.

Figure 7:
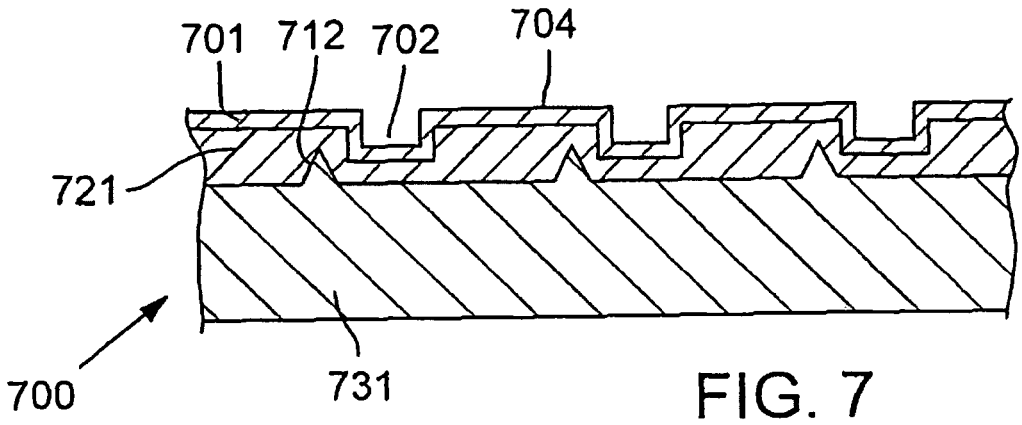
FIG. 7 is a partial sectional view of a striking plate for an iron-type golf club head that includes a contact plate having grooves defined as a plurality of indentations and a back plate that includes a plurality of support protrusions, according to another embodiment.

Referring to FIG. 7, a compound striking plate 700 includes a contact plate 701 that is provided with grooves and formed in striking surface 704. An intermediate layer 721 is situated between a back plate 731 and the contact plate 701. The intermediate layer 721 is a relatively soft layer (i.e., a layer configured to be softer than the contact plate 701 and protrusions 712 in the back plate 731). The intermediate layer 721 generally is arranged to secure the contact layer 701 and the back plate 731 to form a one piece compound striking plate. A plurality of protrusions 712 that extend toward the rear surface of the contact plate 701 are provided. As shown in FIG. 7, the protrusions 712 are offset from the grooves 702. However, in other examples, the protrusions can be situated underneath the grooves 702 or can be slightly offset from a groove center while remaining underneath the grooves 702. Protrusions can be provided for each groove or selected grooves, and different offsets (including both upward and downward offsets) can be provided for some or all grooves, or each protrusion can be situated at a selected offset (or have a selected protrusion configuration such as cross section, protrusion dimension, or material) that can differ from one or all other protrusions.

Figure 8:
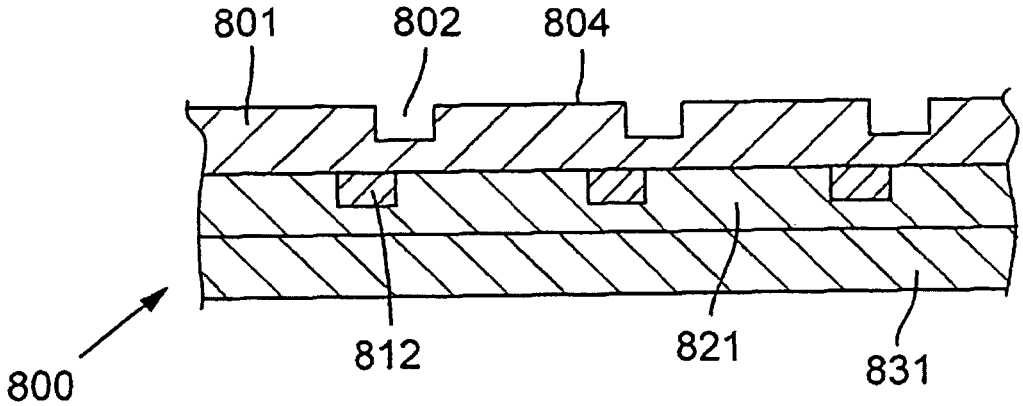
FIG. 8 is a partial sectional view of a striking plate for an iron-type golf club head that includes a contact plate and a back plate separated by a soft layer having a periodically varying thickness, according to another embodiment.

FIG. 8 illustrates a portion of a compound striking plate 800 that includes a contact plate 801, a variable softness intermediate layer 821 and a back plate 831. The contact plate 801 includes a striking face 804 and grooves 802. The intermediate layer 821 includes relief volumes 812 that are filled with a soft material such as a gel or other soft solid or liquid as described above. In some examples, the relief volumes 812 are gas filled or evacuated.

Figure 9:
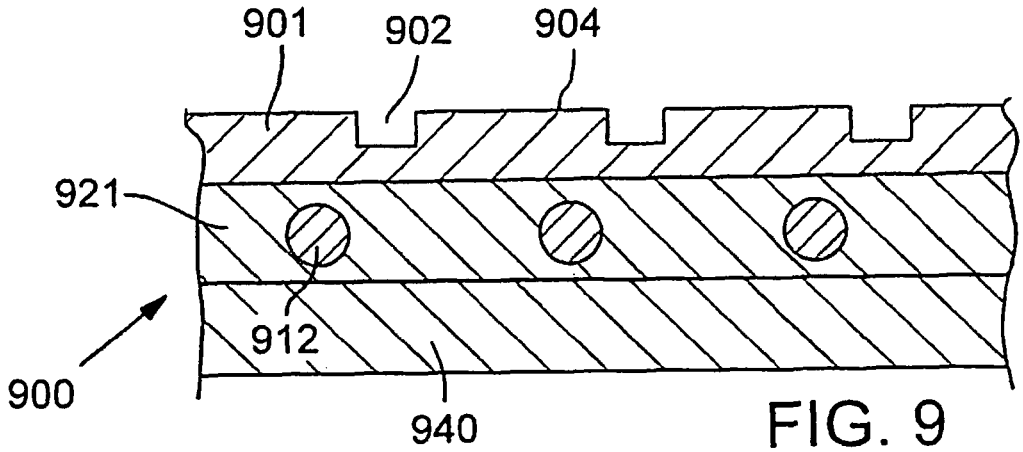
FIGS. 9-17 are partial sectional views of additional representative examples of a striking plate for an iron-type golf club head that include contact plates, intermediate layers, and back plates.

FIG. 9 illustrates a portion of a compound striking plate 900 that includes a contact plate 901, and a variable softness intermediate layer 921 and a back plate 940. The contact plate 901 includes a striking face 904 and grooves 902. The intermediate layer 921 includes relief volumes 912 that are filled with a soft material solid, liquid, gel, or can be gas filled or evacuated. In a convenient example, the intermediate layer 921 is formed of a liquid material (such as an epoxy) that is applied to a plurality of relatively stiffer rods that define the filled relief volumes 912. After the epoxy cures, the rods are fixed with respect to the grooves 902.

Figure 10:
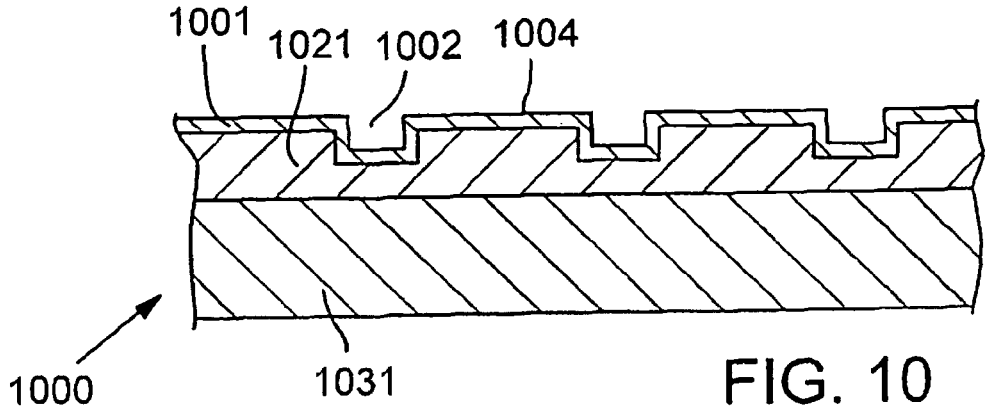

FIG. 10 illustrates a portion of a compound striking plate 1000 that includes a contact plate 1001, a variable softness intermediate layer 1021 and a back plate 1031. The contact plate 1001 includes a striking face 1004 and grooves 1002. The intermediate layer 1021 has a variable thickness to provide variable softness in association with the grooves 1002. Additional stiffeners can be provided at or near some or all grooves to further vary the intermediate layer softness.

Figure 11:
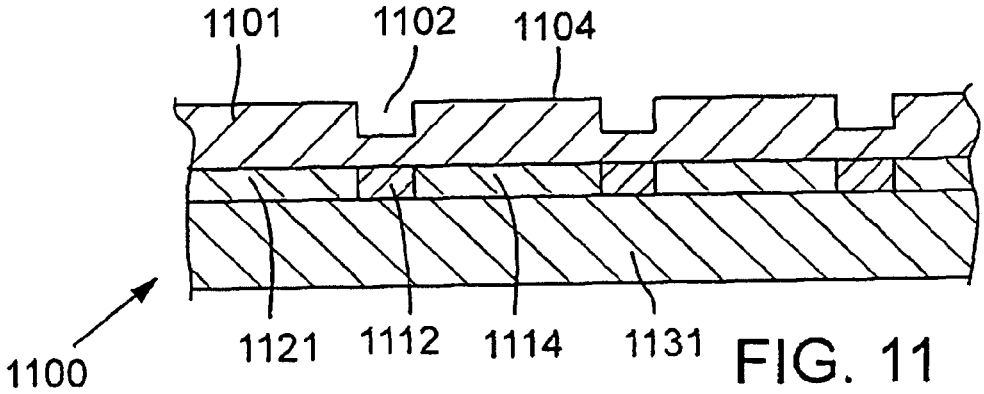

FIG. 11 illustrates a portion of a compound striking plate 1100 that includes a contact plate 1101, a variable softness intermediate layer 1121, and a back plate 1131. The contact plate 1101 includes a striking face 1104 and grooves 1102. The intermediate layer 1121 includes relief volumes 1112 that are filled with a soft material such as a gel or other soft solid, liquid, or gel material as described above. As shown in FIG. 11, the relief volumes extend to a rear surface of the contact plate 1101 and a front surface of the back plate 1131. In other examples, the relief volumes 1112 are based on a material that is generally stiffer than the remainder of the intermediate layer 1121, and can be offset from the grooves 1102. In the examples, portions 1114 of the intermediate layer 1121 can be selected to be more or less soft than the filled relief volumes.

Figure 12:
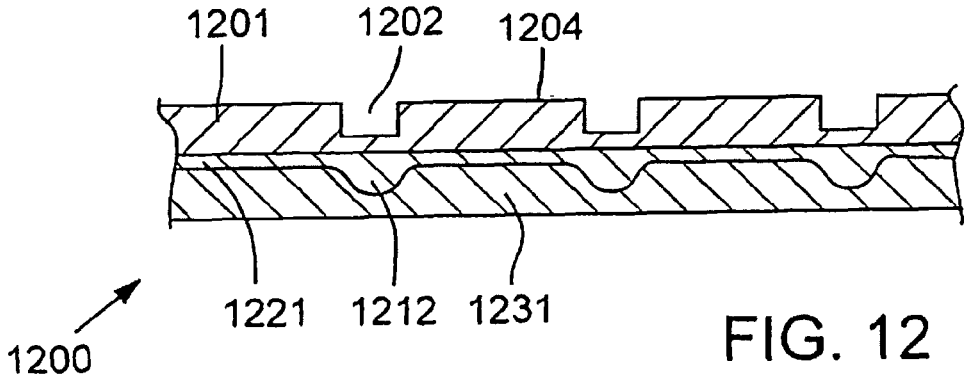

FIG. 12 illustrates a portion of a compound striking plate 1200 that includes a contact plate 1201, a variable softness intermediate layer 1221, and a back plate 1231. The contact plate 1201 includes a striking face 1204 and grooves 1202. The intermediate layer 1221 includes thickened regions 1212 that can be offset from the grooves 1202. Depending on the relative softness of the materials of the intermediate layer 1221 and the back plate 1231, the thickened regions 1212 can serve to locally increase or decrease stiffness which directly impacts vibration absorption and the feel of the golf club upon impact.

Figure 13:
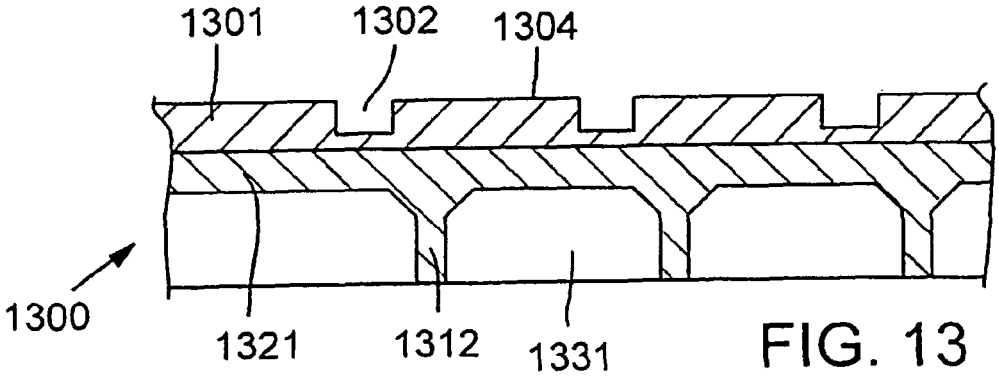

FIG. 13 illustrates a portion of a compound striking plate 1300 that includes a contact plate 1301, a variable softness intermediate layer 1321, and a back plate 1331. The contact plate 1301 includes a striking face 1304 and grooves 1302. The intermediate layer 1321 includes relief extension regions 1312 so that the intermediate layer 1321 extends into the back plate 1331. As shown in FIG. 13, the relief extension regions 1312 are formed of the same material as the intermediate layer 1321, but in other examples, these regions can be filled with a different (harder or softer) material.

Figure 14:
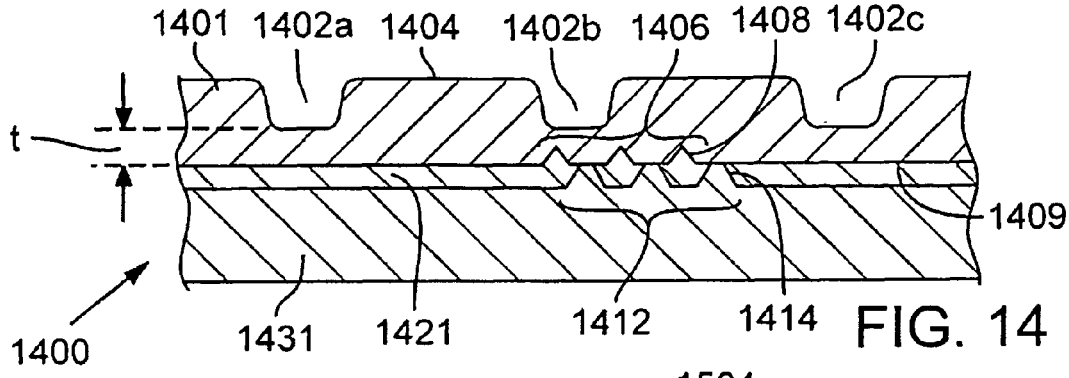

FIG. 14 illustrates a portion of a compound striking plate 1400 that includes a contact plate 1401, an intermediate layer 1421, and a back plate 1431. The contact plate 1401 includes a striking face 1404 and grooves 1402*a*-1402*c*. A rear surface 1409 of the contact plate 1401 includes a softening region 1406 situated at but offset from the groove 1402*b*. The softening region 1406 is conveniently provided as a series of triangular or other grooves 1408 that extend along the groove 1402*b*. In one embodiment, three triangular grooves 1408 are provided in the softening region 1406.

Similar softening regions can be provided for the grooves 1402*a*-1402*c*, if desired. The intermediate layer 1421 includes an extension region 1412 that includes protrusions 1414 that are configured so as to contact a back surface 1409 of the contact plate. In some examples, the intermediate layer 1421 is made of a material that is more or less soft than that of the back plate 1431. The extension regions and the softening regions can be aligned with or offset from corresponding grooves as desired.

Figure 15:
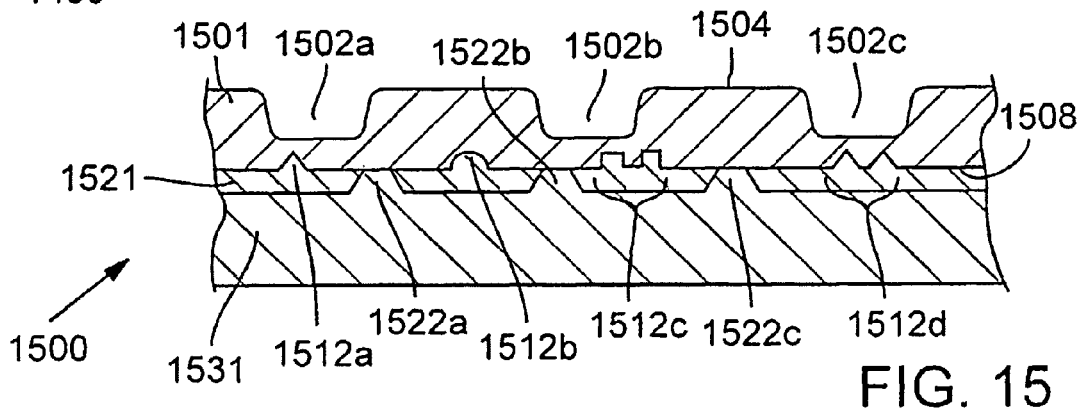

FIG. 15 illustrates a portion of a compound striking plate 1500 that includes a contact plate 1501, a variable softness intermediate layer 1521, and a back plate 1531. Grooves 1502*a*-1502*c* are provided at a striking surface 1504 of the contact plate 1501. A back surface 1508 of the contact plate 1501 is provided with softening regions 1512*a*, 1512*b*, 1512*c*, 1512*d* of various configurations. As shown in FIG. 15, each of the softening regions 1512*a*-1512*d* is associated with varying degrees of feel and softness of the contact plate 1501, but in other examples, one or more or all these softening regions can be configured to locally increase contact plate softness and feel, and can be of the same or similar design. In one embodiment, the softening regions 1512*a*-1512*d* have varying shapes such as triangular, semi-circular, rectangular, or any combination thereof. The rear plate 1531 includes a plurality of protrusions 1522*a*-1522*c* that can be of the same or different designs. These protrusions are situated near a contact surface groove but offset from a groove center.

Figure 16:
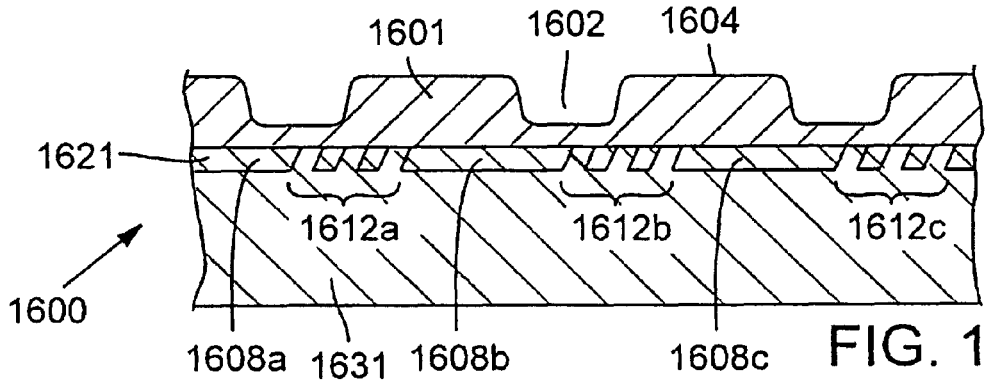

FIG. 16 illustrates a portion of a compound striking plate 1600 that includes a contact plate 1601, a variable softness intermediate layer 1621, and a back plate 1631. The contact plate 1601 includes a striking face 1604 and grooves 1602. The intermediate layer 1621 includes softening regions 1608*a*-1608*c* and stiffening regions 1612*a*-1612*c* that extend parallel to the grooves 1602. In some examples, the intermediate layer 1621 is metallic. As shown in FIG. 16, the back plate material can extend through apertures in the intermediate layers 1621 to the contact plate 1601.

Figure 17:
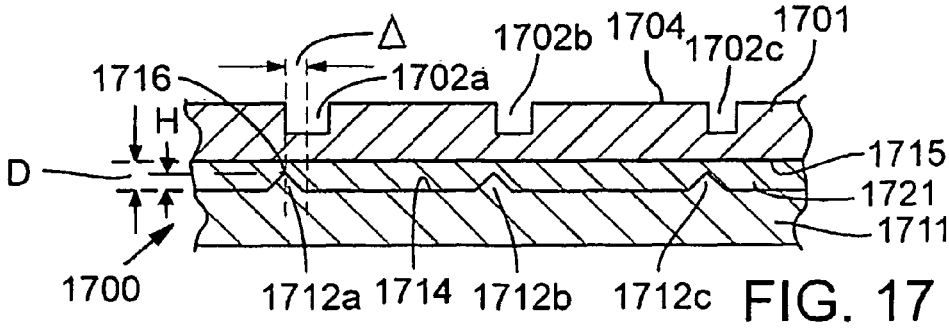

FIG. 17 illustrates a portion of a compound striking plate 1700 that includes a contact plate 1701, an intermediate layer 1721, and a back plate 1711. The contact plate 1701 includes a striking face 1704 with a plurality of grooves 1702*a*-1702*c*. The back plate 1711 includes a plurality of projections 1712*a*-1712*c* of triangular cross section that extend from a rear surface 1714 of the back plate 1711 towards a rear surface 1715 of the contact plate 1701 but remain spaced apart from the contact plate 1701 by the intermediate layer 1721. In other examples, the projections 1712*a*-1712*c* have different shapes, and can extend so as to contact the rear surface 1715 of the contact plate 1701. As shown in FIG. 17, a vertex 1716 of the projection 1712*a* is offset vertically and horizontally a distance Δ from a groove center and a distance H of the intermediate layer 1721. The thickness D or H and the offset Δ can be selected to provide a predetermined locally variable softness.

Figure 18:
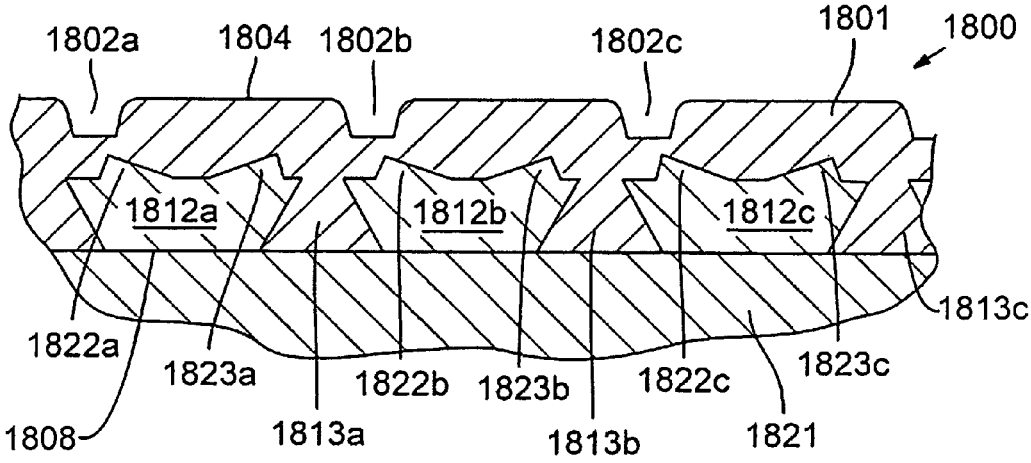
FIG. 18 is a partial sectional view of a striking plate for an iron-type golf club head that includes a plurality of grooves on a striking surface and a corresponding plurality of protrusions in a contact plate that are configured to be mechanically coupled or to be in contact with a back plate, according to another embodiment.

A portion of another representative example of a compound striking plate 1800 is illustrated in FIG. 18. The striking plate 1800 includes a contact plate 1801 and a back plate 1821 that define a plurality of intermediate cavities 1812*a*-1812*c*. The contact plate 1801 includes a plurality of grooves 1802*a*-1802*c* in a striking face 1804. The grooves 1802*a*-1802*c* can be formed by machining, casting, or other processes and, in practical examples, have dimensions, transition radii, and other parameters selected so as to conform to the Rules of Golf. The contact plate 1801 is based on a metal plate of a material such as those mentioned above. In the example of FIG. 18, the contact plate 1801 includes a plurality of rear surface grooves 1822*a*-1822*c*, 1823*a*-1823*c*. In one example, the contact plate thickness is about 3.0 mm.

A plurality of support protrusions 1813*a*-1813*c* in the contact plate 1801 extends towards a front surface 1808 of the back plate 1821. In some examples, the support protrusions 1813*a*-1813*c* are situated so as to contact the front surface 1808 of the back plate 1821, or the support protrusions 1813*a*-1813*c* can be in proximity to the front surface 1808 of the back plate 1821 so that the protrusions 1813*a*-1813*c* are mechanically coupled to the back plate 1821 when a club head incorporating the compound striking plate 1800 contacts a golf ball as a shot is made under typical playing conditions. The back plate 1821 need not be metallic, and can be formed of a variety of metals, plastics, composites, or other materials or combinations of materials such as layers of different materials.

In the example of FIG. 18, the support protrusions 1813*a*-1813*c* can be configured similarly to those of FIG. 2 and can be symmetric or asymmetric, and can have square, rectangular, pyramidal, triangular, oval, semicircular, or other regular or irregular shapes and can all be of the same or different configurations.

The support protrusions 1813*a*-1813*c* are situated so as extend substantially parallel to and offset from corresponding grooves a distance that is less than about ⅓, ⅕, or 1/10 of the distance between grooves (the groove pitch). Protrusion height is generally between about ½ and 2 times the contact plate thickness, but other sizes can be used as convenient.

The support protrusions 1813*a*-1813*c* define intermediate volumes 1812*a*-1812*c* that extend along the support protrusions 1813*a*-1813*c*. The intermediate volumes 1812*a*-1812*c* can be filled with a solid, liquid, or gel material that is softer than the support protrusions 1812*a*-1812*c*. In other examples, the intermediate volumes are gas filled or are evacuated. In still other examples, support protrusions can be arranged to be softer than a fill material in the intermediate volumes.

Figure 19:
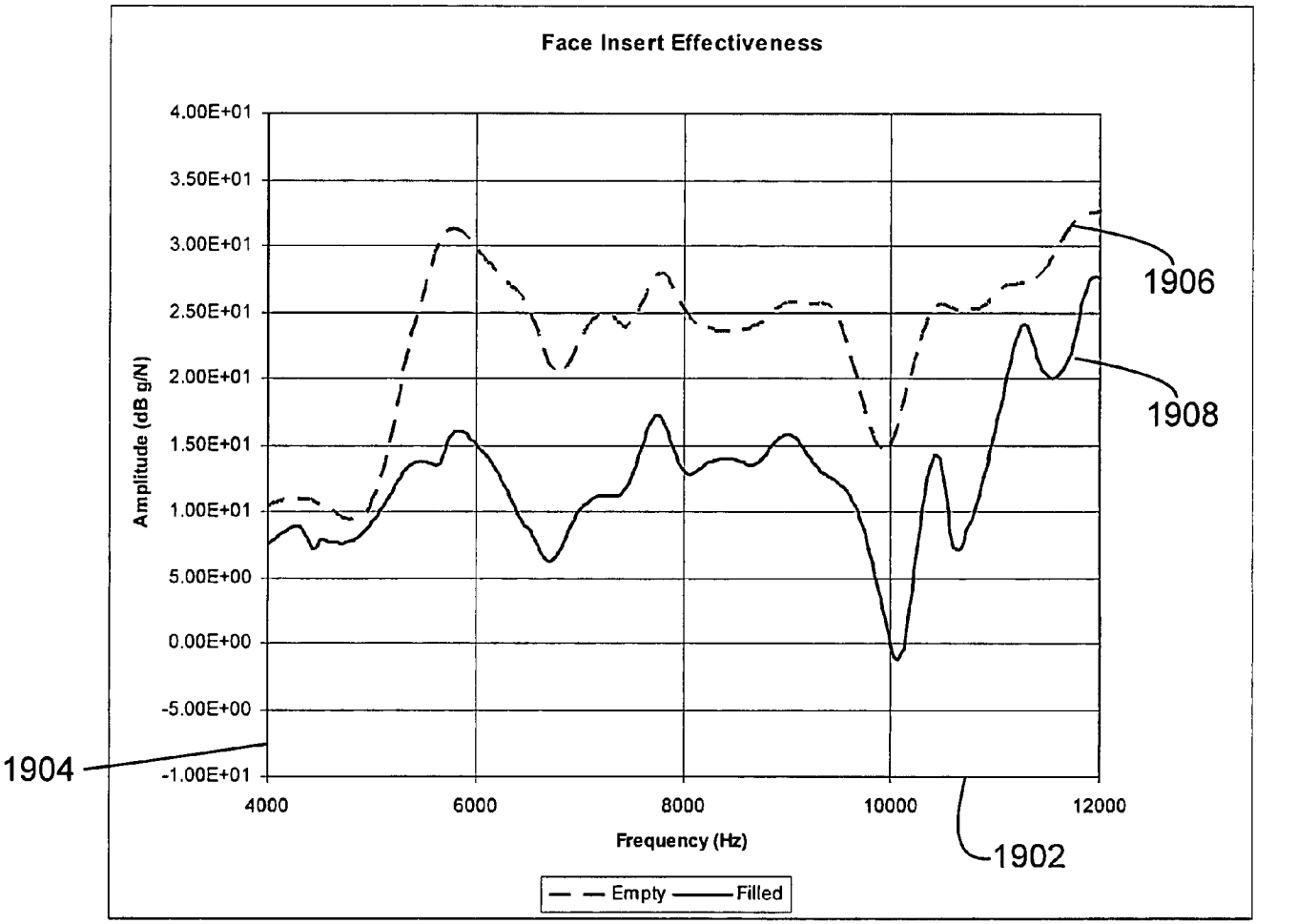
FIG. 19 is a graph plotting the face insert effectiveness, according to one embodiment.

FIG. 19 illustrates a graph 1900 showing test data results for one embodiment similar to the striking plate 200 shown in FIG. 2. The graph 1900 includes an X-axis 1902 showing units of frequency in hertz (Hz) and the Y-axis 1904 of the graph indicates the amplitude in units of decibels (dB) with a reference quantity of g/N where g represents units of acceleration due to gravity and N represents newtons of force from a test hammer.

The graph 1900 is the result of a test procedure in which an accelerometer is affixed to a front portion of the striking plate 130 and a test hammer strikes the center point or sweet spot of the striking plate 130. A first curve 1906 represents the vibration response of a striking plate 130 without any material within the intermediate cavities 212*a*-212*c* whatsoever. In other words, the intermediate cavities 212*a*-212*c* are empty and do not contain a fill material. By comparison, a second line 1908 on the graph 1900 represents the vibration response of a striking plate 130 having the intermediate cavities 212*a*-212*c* filled with a material. In one embodiment, the second line 1908 on the graph 1900 represents intermediate cavities 212*a*-212*c* that are filled with a silicone gel kit, such as a gel containing poly(dimethylsiloxanes), vinyl terminated (at least 70%), (methylhydrosiloxane) (dimethylsiloxane) copolymer (less than 25%), and vinyl modified Q silica resin (less than 5%). In one embodiment, the silicone gel kit is a product from Gelest, Inc. PP2-D200-KIT or PP2-D300-KIT.

FIG. 19 further shows the filled embodiment or second line 1908 having a significantly lower vibration amplitude compared to the first line 1906 representing the embodiment without a filled intermediate cavity. For example, the vibration amplitude of the filled cavity at 6,000 Hz is about 15 dB g/N compared to the unfilled cavity which has a vibration amplitude of about 30 dB g/N. The amplitude at 6,000 Hz of the filled intermediate cavity is almost half that of the unfilled cavity. In general, both the filled and unfilled embodiments have relatively low vibration amplitudes compared to ordinary club heads.

Figure 20:
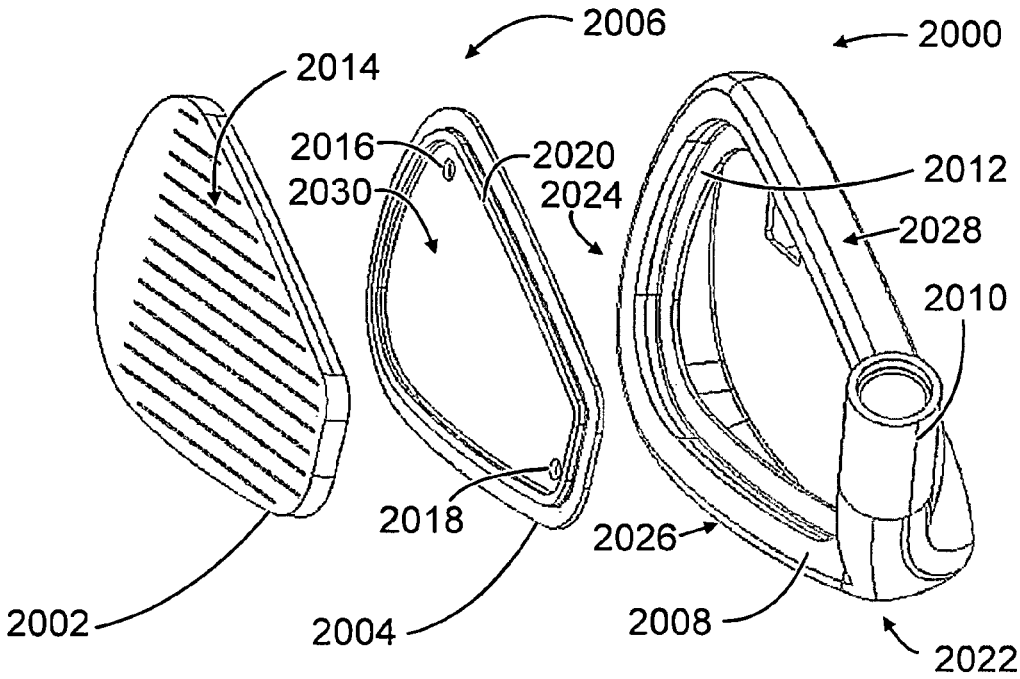
FIG. 20 is an isometric view of a removable face insert on an iron-type golf club head, according to another embodiment.

FIG. 20 further shows another embodiment of a golf club head 2000 in which the above striking plate designs can be implemented. For example, the embodiment described in FIG. 2 can be implemented in a two-piece striking plate insert arrangement. FIG. 20 illustrates a removable two-piece striking plate insert 2006 including a front first piece 2002 and a rear second piece 2004. The front first piece 2002 and the rear second piece 2004 are configured to engage with each other to form the two-piece striking plate insert 2006 that is inserted into the golf club head 2008.

The golf club head 2008 includes a hosel 2010, heel 2022, toe 2024, sole 2026, and top line 2028 as previously described. The golf club head 2008 also includes a support flange or lip 2012 that is configured to support the two-piece striking plate insert 2006. In one embodiment, the two-piece striking plate insert 2006 is supported by an engagement between the support flange or lip 2012 and a circumference or outer edge of the rear second piece 2004 upon assembly. It is understood that the two-piece striking plate insert 2006 can be attached to the golf club head 2008 by bonding, welding, mechanical fastener or any other known attachment means.

FIG. 20 further shows the front first piece 2002 having grooves 2014 on a striking face located on a striking portion as previously described. The front first piece 2002 also has a rear side opposite the striking face that provides a variable thickness across the striking portion of the front first piece 2002. In one embodiment, the rear side has an inverted cone located in a central striking location.

The rear second piece 2004 has an engaging lip 2020 that is a raised protrusion extending about a circumference of the rear second piece 2004. The engaging lip 2020 defines a sidewall of a cavity 2030 created by the assembly of the front first piece 2002 and the rear second piece 2004. The cavity 2030 may be filled with a vibration dampening material as previously described above. The rear second piece 2004 includes a first hole 2016 and a second hole 2018 which can both be used for filling the cavity 2030 with the vibration dampening material after the front first piece 2002 and the rear second piece 2004 are assembled. In another embodiment, it is understood that the first hole 2016 may be used to create a vacuum within the cavity 2030 while the second hole 2018 is utilized as an input for injecting the vibration dampening material.

Figure 21:
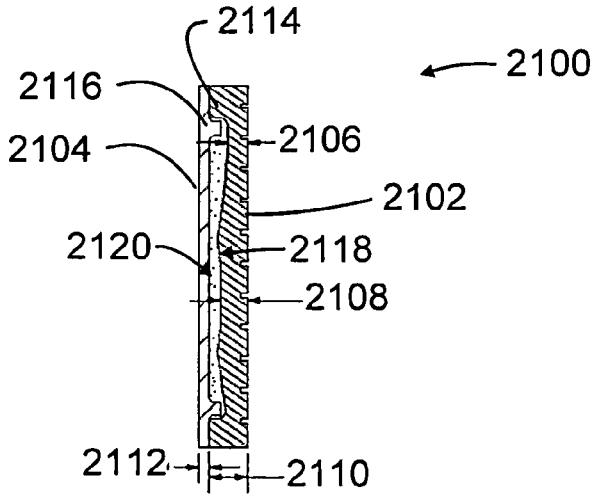
FIG. 21 is cross section view of an exemplary two-piece face insert.

FIG. 21 shows an exemplary two-piece striking plate insert 2100, according to one embodiment, including a front first piece 2102 and a rear second piece 2104. The front first piece 2102 has a protruding edge portion 2114 located along a peripheral outline of the back side of the front first piece 2102. The protruding edge portion 2114 is configured to engage or adapt to a protruding lip 2116 located along a peripheral portion of the rear second piece 2104. The front first piece 2102 and rear second piece 2104 can be attached by bonding, welding, or mechanical fasteners or any other known attachment method. The protruding lip 2116 and the protruding edge portion 2114 form a seal for the cavity 2120 containing a vibration and sound dampening material.

FIG. 21 further shows an inverted cone profile 2118 located on a back portion of the front first piece 2102 and within a sweet spot region for ideal ball impact. The front first piece 2102 has a first thickness 2106 located near the protruding edge portion 2114 and a second thickness 2108 located at the center of the inverted cone profile 2118. In one embodiment, the first thickness 2106 is about 2.1 mm and the second thickness 2108 is about 2.8 mm.

The front first piece 2102 has a thickness measurement which is defined as the largest overall thickness dimension 2110 of the front first piece 2102 that is located near the protruding edge portion 2114. In one embodiment, the overall thickness measurement 2110 of the front first piece 2102 is about 4.0 mm. In addition, the rear second piece 2104 has a complementary thickness 2112 that engages the protruding edge portion 2114 to create an overall thickness of the two-piece striking plate insert 2100. In one embodiment, the complementary thickness 2112 of the rear second piece 2104 is about 1.0 mm and thus creating an overall thickness of the two-piece striking plate insert 2100 of about 5.0 mm. It is understood that the thicknesses of the striking plate insert 2100 can vary without departing from the scope of this invention.

One advantage of the embodiments described above is that the vibration transferred from the contact plate to the back portion or back plate is minimized by the presence of the soft material. The soft material used in the present embodiments will absorb vibration energy that results from the impact between the contact plate and a golf ball. In use, the golf ball impacts the contact plate and transfers energy to the soft material and back plate or portion. As a result, the golf club will feel softer to a golfer upon impact with the golf ball.

It is apparent that the examples described above are representative of the disclosed technology, and that other examples can be provided. Thus, these examples are not to be taken as limiting, and we claim all that is encompassed by the appended claims and the equivalents thereof.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. A golf club head, comprising:

a club body; and a contact plate secured to the club body, the contact plate defining at least a portion of a striking surface having a plurality of striking surface grooves, and a plurality of soft portions coupled to a rear surface of the contact plate, the plurality of soft portions corresponding to the plurality of striking surface grooves;

wherein the plurality of soft portions are located in at least one cavity, the at least one cavity defined by a varying thickness of a back portion.

2. The golf club head of claim 1, wherein the plurality of soft portions are located directly behind the plurality of striking surface grooves.

3. The golf club head of claim 1, wherein the plurality of soft portions are substantially offset from the striking surface grooves.

4. The golf club head of claim 1, wherein at least one soft insert in a back portion includes the plurality of soft portions.

5. The golf club head of claim 1, wherein the plurality of soft portions are configured to provide at least one soft portion that corresponds to each striking surface groove of the plurality of striking surface grooves.

6. The golf club head of claim 1, wherein the back portion defines at least one cavity portion located between the back portion and the contact plate, the at least one cavity portion having a first volume.

7. The golf club head of claim 6, wherein the contact plate includes at least one rear surface groove having a groove volume.

8. The golf club head of claim 7, wherein the first volume of the at least one cavity portion includes the groove volume of the at least one rear surface groove.

9. The golf club head of claim 6, wherein the at least one cavity portion is filled with a gel.

10. The golf club head of claim 6 wherein the at least one cavity portion is a channel that extends to at least one fill aperture.

11. A golf club head, comprising:

a striking plate comprising a plurality of grooves defined on a striking surface; and a head body comprising a forward surface at which the striking plate is secured to the head body, wherein the forward surface defines at least one support protrusion that in combination with the striking plate defines a channel located between a rear surface of the striking plate and the forward surface;

wherein the at least one support protrusion is a plurality of support protrusions that include horizontal portions that extend substantially parallel to the respective plurality of grooves, and the horizontal portions include a horizontal portion centerline that is vertically offset from a respective groove centerline by a distance of between about 0.05 mm and 1.5 mm.

12. The golf club head of claim 11, wherein the channel is substantially unfilled.

13. The golf club head of claim 11, wherein the channel is substantially filled with a gel or polymer.

14. The golf club head of claim 11, wherein the channel is substantially filled with a solid that is less stiff than the head body.

15. A golf club head, comprising:

a club body; and a contact plate secured to the club body, the contact plate defining at least a portion of a striking surface having a plurality of striking surface grooves, and a plurality of soft portions coupled to a rear surface of the contact plate, the plurality of soft portions corresponding to the plurality of striking surface grooves;

wherein a back portion defines at least one cavity portion located between the back portion and the contact plate, the at least one cavity portion having a first volume, wherein the at least one cavity portion is a channel that extends to at least one fill aperture.

16. The golf club head of claim 15, wherein the contact plate includes at least one rear surface groove having a groove volume.

17. The golf club head of claim 16, wherein the first volume of the at least one cavity portion includes the groove volume of the at least one rear surface groove.

18. The golf club head of claim 15, wherein the at least one cavity portion is filled with a gel.

* * * * *